United States Patent [19]

Landry

[11] 4,420,022

[45] Dec. 13, 1983

[54] LIQUEFIED GAS FILLING DEVICE

[76] Inventor: George H. Landry, 4669 Pardee, Dearborn Heights, Mich. 48125

[21] Appl. No.: 251,327

[22] Filed: Apr. 6, 1981

[51] Int. Cl.[3] ..... B65B 3/04

[52] U.S. Cl. ..... 141/18; 141/350; 141/98; 137/382; 137/540; 285/61; 285/161; 285/203; 285/330

[58] Field of Search ..... 137/540, 360, 361, 382; 285/61, 161, 203, 330; 141/18, 346–362, 382–386, 392, 98

[56] References Cited

U.S. PATENT DOCUMENTS

| | | | |
|---|---|---|---|
| 661,671 | 11/1900 | Schrader | 137/540 |
| 1,246,772 | 11/1917 | Morris | 137/382 |
| 1,715,538 | 6/1929 | Dean et al. | 137/382 |
| 2,553,342 | 5/1951 | Trageser | 285/330 |
| 2,639,723 | 5/1953 | Bierman et al. | 137/382 |
| 2,745,432 | 5/1956 | Williams | 137/540 |
| 2,959,188 | 11/1960 | Kepner | 137/540 |

*Primary Examiner*—Houston S. Bell, Jr.
*Attorney, Agent, or Firm*—Cullen, Sloman, Cantor, Grauer, Scott & Rutherford

[57] ABSTRACT

A liquefied gas filling device for dwelling related liquefied gas (LPG) containers is disclosed. The device of the present invention comprises a box like container including an interior wall with the container enclosing a receptacle. The container includes a hinged door with a lock to prevent unauthorized access to the container interior. The receptacle bulkhead is mounted to the interior wall and includes a threaded outlet end with a pair of opposed flats formed thereon removing a portion of the thread. The outlet end snugly engages a complementary opening formed in the interior wall wherein the flats prevent rotation of the receptacle. The outlet end terminates at a shoulder which abuts the interior wall, and a jam nut threadingly engaging the outlet end holds the shoulder in abutment with the interior wall with the receptacle locked against rotation with respect to the interior wall.

2 Claims, 5 Drawing Figures

LIQUEFIED GAS FILLING DEVICE

BACKGROUND OF THE INVENTION

I. Field of the Invention

The present invention generally relates to liquefied gas storage containers and, in particular, the present invention is concerned with filling devices for dwelling liquefied gas containers.

II. Description of the Prior Art

In recent years there has been a concern by the public for protecting the filling devices for dwelling related liquefied gas storage containers such as are used in mobile homes and the like. A damaged filling device can result in the leakage of gas with a resulting loss in valuable energy resources and considerable expense. Recently laws have been passed requiring that dwelling filling devices for liquefied gas be secured in a locked container accessible only by a key owned by the utility which provides the liquefied gas. This lock box provides protection for the filling device from vandalism and accidental damage, but requires the use of a bulkhead mounted receptacle including a check valve connected to conduit extending between the receptacle and the storage tank. The receptacle includes a threaded fitting to which a quick attach coupling is coupled for filling the liquefied gas container from a tanker. Frequent coupling and uncoupling of the tanker to the receptacle often results in rotation of the receptacle relative to container wall to which it it mounted. This rotation results in a loosening of the receptacle which can cause a leakage of gas. Examples of bulkhead mounted valves are disclosed in U.S. Pat. Nos.: 661,671; 2,745,432; and 2,959,188. These patents are relevant to the Applicant's invention in that they represent the closest prior art for bulkhead mounted valves.

III. Prior Art Statement

The aforementioned prior art, in the opinion of the Applicant and the Applicant's Attorney represents the closest prior art of which the Applicant and his Attorney are aware.

SUMMARY OF THE INVENTION

The present invention, which will be described in greater detail hereinafter, comprises a filling device for dwelling liquefied gas containers and includes a container that encloses the receptacle and includes a hinged door with a lock to prevent unauthorized access to the container interior. The receptacle is bulkhead mounted and includes a check valve allowing a one way flow of fluid from the inlet to the outlet. The outlet end is interconnected to the liquefied gas storage container by means of a suitable conduit. The outlet includes a device for securing the check valve to the interior wall and preventing rotation of the check valve relative to the wall. The inlet end is threaded to accommodate a quick attach-detach coupling to receive liquefied gas from a mobile tanker.

It is therefore a primary object of the present invention to provide a filling device for dwelling liquid gas containers.

It is a further object of the present invention to provide such a filling device having a means for enclosing a liquefied gas receptacle.

It is also an object of the present invention to provide a filling device for dwelling liquid gas containers wherein a means is provided to enclose the receptacle and includes a lock means to prevent unauthorized access to the receptacle.

It is a further object of the present invention to provide a filling device for dwelling liquid gas containers wherein the receptacle is secured in a container when not in use and the receptacle is mechanically secured against rotation relative to the container.

Further objects, advantages, and applications of the present invention will become apparent to those skilled in the art of liquefied gas filling devices when the accompanying description of one example of the best mode contemplated for practicing the invention is read in conjunction with the accompanying drawing.

BRIEF DESCRIPTION OF THE DRAWING

In the drawing like reference numbers refer to like parts throughout the several views and wherein.

DESCRIPTION OF THE PREFERRED EMBODIMENT

Figure 1:
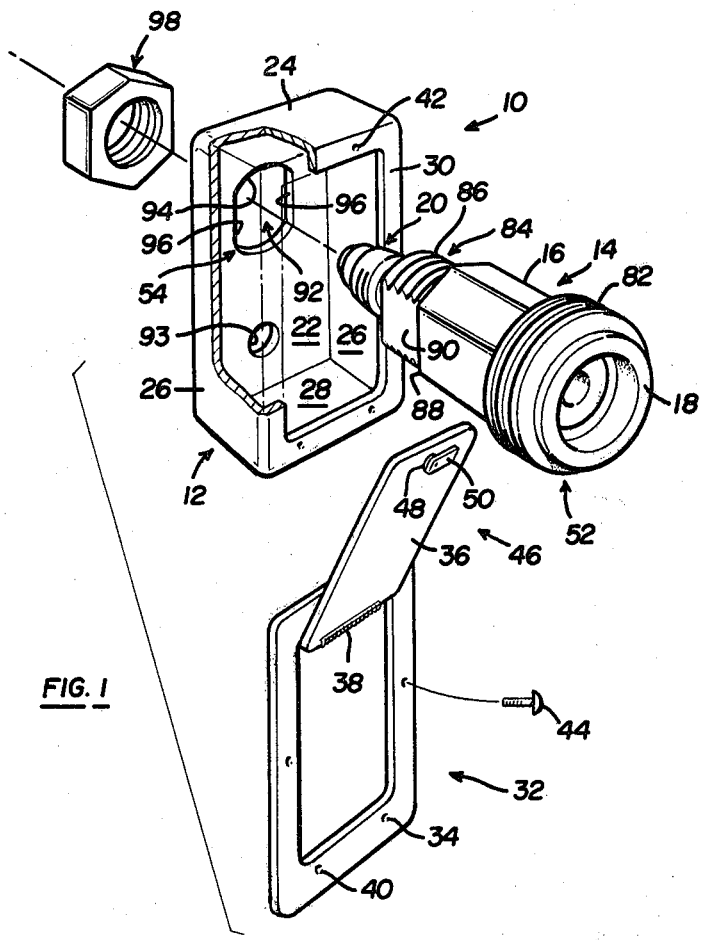
FIG. 1 illustrates an exploded perspective view of the receptacle and filling device of the present invention.
Figure 2:
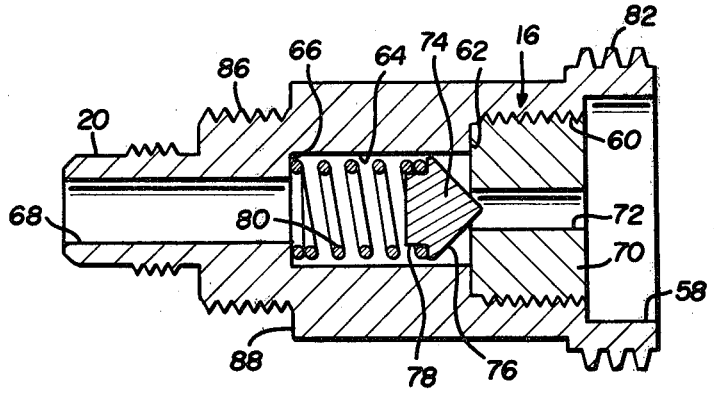
FIG. 2 illustrates a cross sectional view of the check valve in the receptacle of the present invention.

Referring now to the drawing and in particular to FIG. 1 wherein there is illustrated at 10 one example of the present invention in the form of a filling device for dewlling liquefied gas storage containers. The filling device 10 includes a container 12 enclosing a receptacle 14. The receptacle 14 includes a check valve 16, an inlet end 18 and an outlet end 20. The receptacle is bulkhead mounted to an interior wall 22 of the container 12. The container 12 comprises a top wall 24 integral with the interior wall 22, a pair of opposed side walls 26 integral with the top wall 24 and the interior wall 22, and a bottom wall 28 extending between and integral with the pair of side walls 26 and with the interior wall 22. A flange 30 extends around the open end of the container 12 and is integral with the top wall, the pair of side walls 26, and the bottom wall 28. A cover assembly 32 includes a frame 34 having outside dimensions complementary to the outer edges of the flange 30 and a hinged cover 36 hinged to the frame 34 by a piano hinge 38. The cover assembly 32 is mounted to the flange 30 by a plurality of apertures 40 along the frame 34 aligned with a plurality of threaded apertures 42 in the flange 30 and a plurality of screws engage the plurality of apertures 40 and threadingly engage the threaded apertures 42 to secure the cover assembly 32 to the flange 30. The cover assembly 32 further includes a lock means 46 to prevent unauthorized access to the interior of the container 12. The lock means 46 comprises a key operated barrel 48 secured to the cover and a latch 50 journalled to the barrel with the latch movable from a first position engaging the flange to a second position rotated free of the flange to allow the cover to be opened.

The receptacle and filling device 10 as illustrated in FIG. 1 of the drawing includes a means 52 for releasably engaging a source of liquefied gas and a means 54 for securing the filling device to the interior wall 22 and preventing rotation of the receptacle 14 relative to the wall.

The check valve 16 is disposed within the receptacle 14 and includes a step bore with a filler diameter 58 at an outer end and a threaded diameter 60 inward from the filler diameter 58 terminating in a shoulder 62. A poppet guide diameter 64 extends inward a distance from the shoulder terminating at a spring seat 66. An outlet bore 68 communicates with the poppet guide diameter 64 extending through to the outlet end 20. A seat 7 threadingly engages the threaded diameter 60 and abuts the shoulder 62 and includes a central bore 72. A poppet 74 includes a conical end 76 selectively engaging the central bore 72 and a spring guide 78 at an inside end. A compression spring 80 snugly engages the spring guide 78 at one end and abuts the spring seat 66 at another end and gently biases the poppet 74 against the seat 70 to form a seal and allow a one way flow of fluid past the poppet 74.

The means 52 for releaseably engaging a source of liquefied gas comprises a threaded fitting 82 adapted for coupling to a quick attach-detach female fitting (not shown) with the quick attach-detach coupling hydraulically interconnected to a source of liquefied gas such as a tanker trailer.

The means 54 for securing the receptacle 14 to the interior wall 22 and preventing rotation of the receptacle 14 relative to the wall 22 comprises a second threaded fitting 84 including threads 86 formed along the outlet end 20 with an inward end of the second threaded fitting terminating at a shoulder 88. A pair of opposed flats 90 are formed along the second threaded fitting 84 removing a portion of the threads 86. An aperture 92 is formed through the interior wall 22 with the aperture 92 including a pair of opposed arcuate sides 94 slidingly clearing the threads 86 and a pair of opposed parallel sides 96 to slidingly clear the flats 90. The outlet end 20 slidingly engages the aperture 92 and a jam nut 98 threadingly engages the threads 86 to cause the shoulder 88 to abut the interior wall 22 with the flats 90 abutting the opposed sides 96 to prevent rotation of the receptacle 14 relative to the container 12.

It should be noted with respect hereto that the means 52 may be modified to eliminate the poppet valve 74 and spring 80 as well as the seat 70 therefore. This renders the means 52 a delivery conduit, solely under each circumstances. When the tank to be filled (not shown) is full, excess liquified fuel then bleeds off through the means 52 to the atmosphere. Aperture 93 is alternately used to mount a relief valve (not shown) to bleed off excess LPG when the tank (not shown) has been over filled. Conduit 95 extends from the tank to the relief valve to carry away excess LPG.

In a preferred embodiment, an opening 93 is formed in the interior wall 22 to mount an overflow valve (not shown). During filling of the liquefied gas storage tank, any excess liquid resulting from an over filling of the tank is directed to the overflow valve by suitable interconnecting conduit 95.

Figure 3:
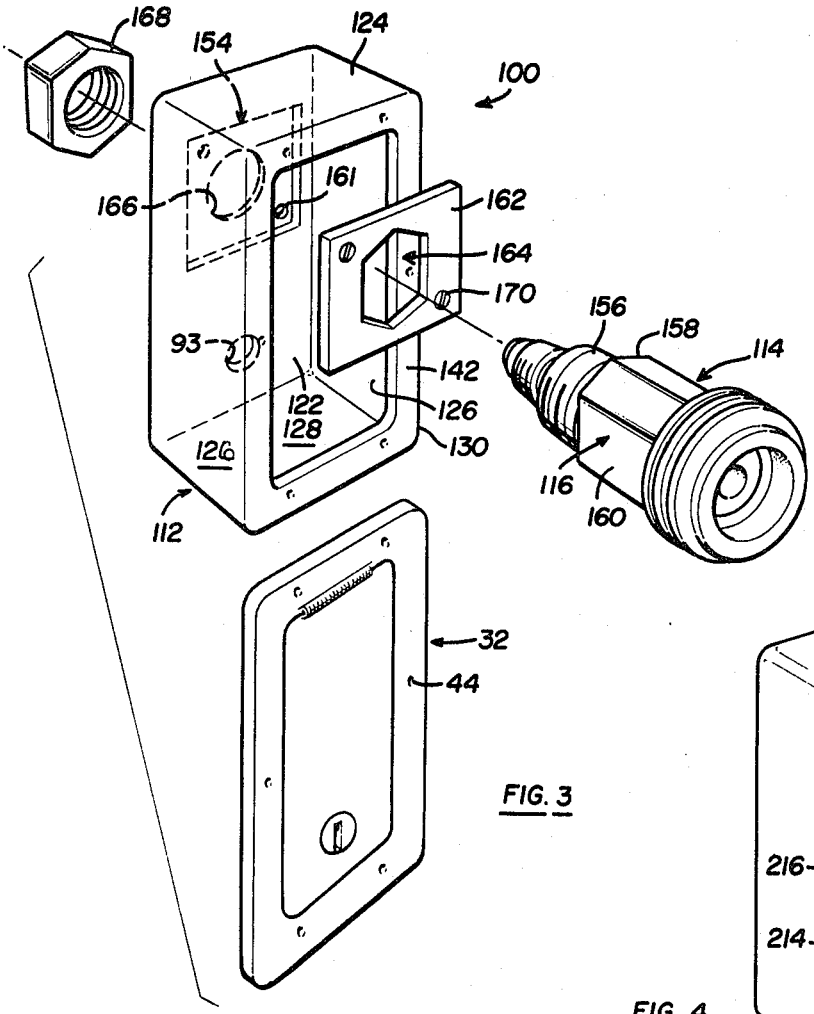
FIG. 3 illustrates an exploded perspective view of an alternate embodiment of the present invention.

Referring now to FIG. 3 of the drawing, there is illustrated at 100 an alternate embodiment of the present invention employing an alternate means 154 for securing a receptacle 114 to an interior wall 122 and preventing rotation of the receptacle 114 relative to the wall 122. A container 112 includes the interior wall 122, a top wall 124 integral with the interior wall 122, a pair of opposed side walls 126 integral with the interior wall 122 and a top wall 124, and a bottom wall 128 integral with the side walls 126 and the interior wall 122. A flange 130 extends around the perimeter of the top wall, bottom wall, and the pair of opposed side walls 126 and includes a plurality of apertures 142 for securing the the cover assembly 32 thereto utilizing threaded fasteners 44. The receptacle 114 includes a bulkhead mounted check valve 116 including a third threaded fitting 156 terminating at its inner end at a fitting shoulder 158. At least one flat 160 is formed on an outer edge of the fitting shoulder 158. A plate 162 is securely attached to the interior wall 122, with the plate 162 having a perimeter complementary to the shoulder outer edge to snugly receive the outer edge. A through aperture 166 is formed in the interior wall 122 to slidingly receive the third threaded fitting 156, and a nut 168 threadingly engages the third threaded fitting 156 to abut the fitting shoulder 158 against the interior wall 122 with the flat 160 abutting the plate aperture 164 to prevent rotation of the receptacle relative to the interior wall 122.

The plate 162 is nestingly received in a complimentary recess formed in the interior wall 122. One or more screws 170 engage an aperture formed in plate 162 and threadingly engage the interior wall 122 to releasably secure the plate 122 thereto. Plate 122 may be readily removed and the through aperture 166 employed to mount a standard bulkhead fitting.

Figure 4:
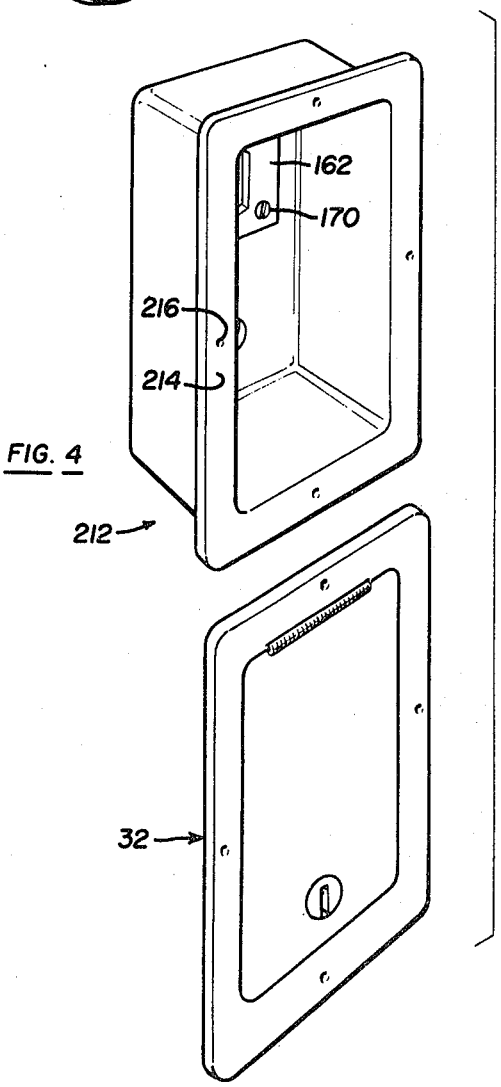
FIG. 4 illustrates an exploded perspective view of the present invention utilizing a box with outward directed flanges.

In a further embodiment hereof, as shown in FIG. 4, the receptacle 212 has its peripheral flange 214 extending outwardly and laterally away from the walls of the recetpacle. The out-turned flange facilitates mounting of the device to a dwelling. According to the embodiment a weld nut 216 or the like is formed on the flange for receiving a threaded fastener therethrough to mount the receptacle to the dwelling. In all other respects the receptacle remains as defined herein above.

Figure 5:
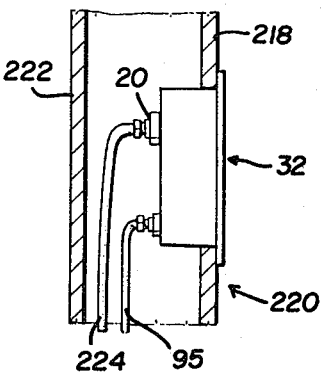
FIG. 5 illustrates a circuit diagram of the present invention.

In using the present invention, it is contemplated that the receptacle be installed between the interior and exterior wall of a mobile home or similar type dwelling. As shown in FIG. 5, the door 32 is contiguous with the exterior wall 218 of a dwelling, generally denoted at 220. The receptacle 32 or 112 is intermediate the exterior wall 218 and the interior wall 222. The means 52, when mounted has the outlet 20 connected to a hose 224 which leads to an LPG storage container or the like (not shown) as illustrated in FIG. 5

Having, thus, described the invention what is claimed is:

1. A filling device for a liquefied gas container comprising:

a box-shaped housing mountable on the exterior wall of a support structure, said housing having an interior wall and a receptacle located in said housing for receiving liquefied gas;

said receptacle having a unitary body including an inlet end and an outlet end, said inlet end of said receptacle having means for quick attach-detach coupling with a source of liquefied gas, said outlet end received through an aperture in said housing interior wall, and said outlet end connected to said liquefied gas container;

said receptacle having an inlet passage extending through said inlet end, an outlet passage extending through said outlet end, and an intermediate chamber located between said inlet and outlet passages, a check valve located in said intermediate chamber including a spring-biased poppet, and said poppet permitting one-way flow of liquefied gas from said inlet passage through said intermediate chamber to said outlet passage;

said receptacle outlet end including a threaded end portion which is connectable with said liquefied gas container, an enlarged threaded intermediate portion spaced from said threaded end portion, and a pair of flat surfaces on opposed sides of said threaded intermediate portion;

said housing interior wall aperture and said receptacle intermediate portion providing anti-rotation means for preventing rotation of said receptacle relative to said housing, said housing interior wall aperture including a pair of arcuate ends and a pair of opposed elongated parallel sides interconnecting said arcuate ends, said arcuate ends slidably clearing said receptacle threaded intermediate portion and said opposed parallel sides slidably engaging said receptacle intermediate flat surfaces, and means engaging said enlarged threaded intermediate portion for securing said receptacle against said housing interior wall with said receptacle intermediate flat surfaces engaging said wall aperture parallel sides thereby preventing rotation of said receptacle relative to said housing interior wall; and said anti-rotation means preventing loosening of the connection between said liquefied gas container and said threaded receptacle outlet end portion during the coupling or uncoupling between said receptacle inlet end and said source of liquefied gas.

2. A filling device for a liquefied gas container comprising:

a box-shaped housing mountable on the exterior wall of a support structure, said housing having an interior wall and a receptacle located in said housing for receiving liquefied gas;

said receptacle having a unitary body including an inlet end and an outlet end, said inlet end of said receptacle having means for quick attach-detach coupling with a source of liquefied gas, said outlet end received through an aperture in said housing interior wall, and said outlet end connected to said liquefied gas container;

said receptacle having an inlet passage extending through said inlet end, an outlet passage extending through said outlet end, and an intermediate chamber located between said inlet and outlet passages, a check valve located in said intermediate chamber including a spring-biased poppet, and said poppet permitting one-way flow of liquefied gas from said inlet passage through said intermediate chamber to said outlet passage;

said recpetacle outlet end including a threaded end portion which is connectable to said liquefied gas container, an enlarged threaded intermediate portion spaced from said threaded end portion terminating at a fitting shoulder, and at least one flat surface formed on an outer edge of said fitting shoulder;

a recess formed in said housing interior wall adjacent to said aperture, an anti-rotation member fitted into said recess with an aperture being formed in said member which is complementary to the fitting shoulder outer edge for receiving the outer edge of said fitting shoulder, said housing interior wall aperture slidably receiving said threaded receptacle intermediate portion, and means engaging said threaded receptacle intermediate portion for securing said receptacle to said housing with said fitting shoulder outer edge engaging the complementary aperture in said anti-rotation member for preventing rotation of said receptacle relative to said housing interior wall; and said anti-rotation member and said fitting shoulder outer edge providing an anti-rotation means for preventing loosening of the connection between said liquefied gas container and said threaded receptacle end portion during coupling or uncoupling of said receptacle inlet end to said source of liquefied gas.

* * * * *